US006851197B2

(12) United States Patent
Terry et al.

(10) Patent No.: US 6,851,197 B2
(45) Date of Patent: Feb. 8, 2005

(54) LAYOUT DEVICE FOR AN ARCHERY BOW

(76) Inventors: Edgell Terry, 1115 Shady La., Rome City, IN (US) 46784; Herman Sells, 324 Lovett St., Wolcottville, IN (US) 46795; Marvin Hoover, 443 W. Greenwood Dr., Kendallville, IN (US) 46755

( * ) Notice: Subject to any disclaimer, the term of this patent is extended or adjusted under 35 U.S.C. 154(b) by 0 days.

(21) Appl. No.: 10/413,792

(22) Filed: Apr. 15, 2003

(65) Prior Publication Data

US 2004/0205971 A1 Oct. 21, 2004

(51) Int. Cl.[7] ..... F41G 1/467

(52) U.S. Cl. ..... 33/265; 33/286; 33/DIG. 21; 124/87

(58) Field of Search ..... 33/265, 1 G, 227, 33/286, 613, 645, DIG. 21, 533; 124/87

(56) References Cited

U.S. PATENT DOCUMENTS

| | | | | | |
|---|---|---|---|---|---|
| 3,641,675 | A | | 2/1972 | Funk, Jr. | |
| 4,473,058 | A | | 9/1984 | Terry | |
| 4,899,452 | A | * | 2/1990 | Schafer | 33/296 |
| 5,400,514 | A | * | 3/1995 | Imbrie et al. | 33/286 |
| 5,495,675 | A | | 3/1996 | Huang | |
| 5,505,000 | A | * | 4/1996 | Cooke | 33/286 |
| 5,782,002 | A | * | 7/1998 | Reed | 33/265 |
| 5,784,182 | A | | 7/1998 | Francoeur et al. | |
| 5,914,775 | A | | 6/1999 | Hargrove et al. | |
| 5,996,569 | A | | 12/1999 | Wilson | |
| 6,073,352 | A | | 6/2000 | Zykan et al. | |
| 6,134,793 | A | | 10/2000 | Sauers | |
| 6,199,286 | B1 | * | 3/2001 | Reed et al. | 33/265 |
| 6,366,344 | B1 | | 4/2002 | Lach | |
| 6,470,579 | B2 | * | 10/2002 | Allen | 33/286 |
| 6,526,666 | B1 | * | 3/2003 | Lastinger, Jr. | 33/265 |

* cited by examiner

*Primary Examiner*—Diego F. Gutierrez
*Assistant Examiner*—Tania Courson
(74) *Attorney, Agent, or Firm*—Taylor & Aust, P.C.

(57) ABSTRACT

A layout device is used with an archery bow. The bow has a riser and a pair of flexible limbs extending oppositely from the riser. The layout device includes a frame with an arm configured for coupling with the riser. The arm has a longitudinal axis. An axial adjustment mechanism is carried by the frame, and is movable relative to the frame in a direction generally orthogonal to the longitidinal axis. A laser is carried by the axial adjustment mechanism. The laser is rotatable at least approximately 180° about a rotation axis extending generally orthogonal to the longitudinal axis.

21 Claims, 2 Drawing Sheets

LAYOUT DEVICE FOR AN ARCHERY BOW

BACKGROUND OF THE INVENTION

1. Field of the Invention

The present invention relates to archery equipment, and, more particularly, to the use of lasers with archery equipment.

2. Description of the Related Art

Devices are known which provide improved accuracy for individuals target shooting and hunting with archery equipment. For example, bow sights have long been used to provide improved accuracy of an archery bow. A rear sight may be in the form of a bow string mounted peep sight having a small hole which is aligned with a forward sight pin mounted on the bow riser for substantially increasing the accuracy of the bow. As a further example, the front sight may be in the form of multiple, vertically aligned horizontal pins mounted in a frame to protect the pins. These multi-pin sights have proliferated in the last few years, especially in the hunting arena, where the distance to a target can vary as much as from 10–60 yards. Optical lenses defining a scope sight may also be used to provide improved accuracy. Yet still, it is also known to use a laser sight which is aligned at a fixed position relative to the riser of the bow to project a laser beam and ultimately a red dot onto a target.

When shooting an archery bow, the trajectory of an arrow must be accurately predicted if an archer is to have confidence in accurate shot placement on a target. The above-mentioned improvements in sights for bows assist in accurately projecting the point of impact at which the arrow is to strike. However, whether the sights are in the form of pin sights, optical lens sights or laser sights, they all assume that the physics of the archery bow are correct during use. Unless the various components making up the archery bow are properly aligned relative to each other, the dynamics of the bow during use may cause force vectors in unknown or undesired directions to exert lateral or other undesirable forces on the arrow causing inaccuracy of a shot.

Heretofore, aligning an archery bow has generally been done through visual alignment and/or mechanically through the use of squares, etc. Although these techniques may be used to avoid gross misalignment of the archery bow, they nonetheless are imprecise and do not ensure exact positioning of the components of the archery bow relative to each other to provide maximum accuracy.

What is needed in the art is a method of aligning or "laying out" an archery bow so that all critical components are properly positioned relative to each other to ensure maximum accuracy. What is further needed in the art is a layout device for use with an archery bow that ensures that all critical parts of the bow affecting the flight path of the arrow lie in a common plane.

SUMMARY OF THE INVENTION

The present invention provides a layout device for an archery bow with a laser which is aligned with a travel path of the arrow, and rotated 360° to ensure that all critical parts of the bow are in a common plane.

The invention comprises, in one form thereof, a layout device for use with an archery bow. The bow has a riser and a pair of flexible limbs extending oppositely from the riser. The layout device includes a frame with an arm configured for coupling with the riser. The arm has a longitudinal axis. An axial adjustment mechanism is carried by the frame, and is movable relative to the frame in a direction generally orthogonal to the longitidinal axis. A laser is carried by the axial adjustment mechanism. The laser is rotatable at least approximately 180° about a rotation axis extending generally orthogonal to the longitudinal axis.

The invention comprises, in another form thereof, an archery bow assembly including a bow having a riser and a pair of flexible limbs extending oppositely from the riser. The bow has a longitudinal axis. A layout device is coupled with the riser. The layout device includes a laser which is rotatable at least approximately 180° about a rotation axis extending generally orthogonal to the longitudinal axis.

An advantage of the present invention is that critical components of the archery bow may be precisely located relative to each other to ensure maximum accuracy.

Another advantage is that only some or all of the components of the archery bow may be checked using the layout device of the present invention.

Yet another advantage is that the layout device of the present invention provides both coarse and fine axial adjustment of the laser relative to a reference axis.

A further advantage is that the laser is rotatable in a 360° arc.

A still further advantage is that the laser has an on-board power supply in the form of a battery to eliminate the need for electric cables, etc.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
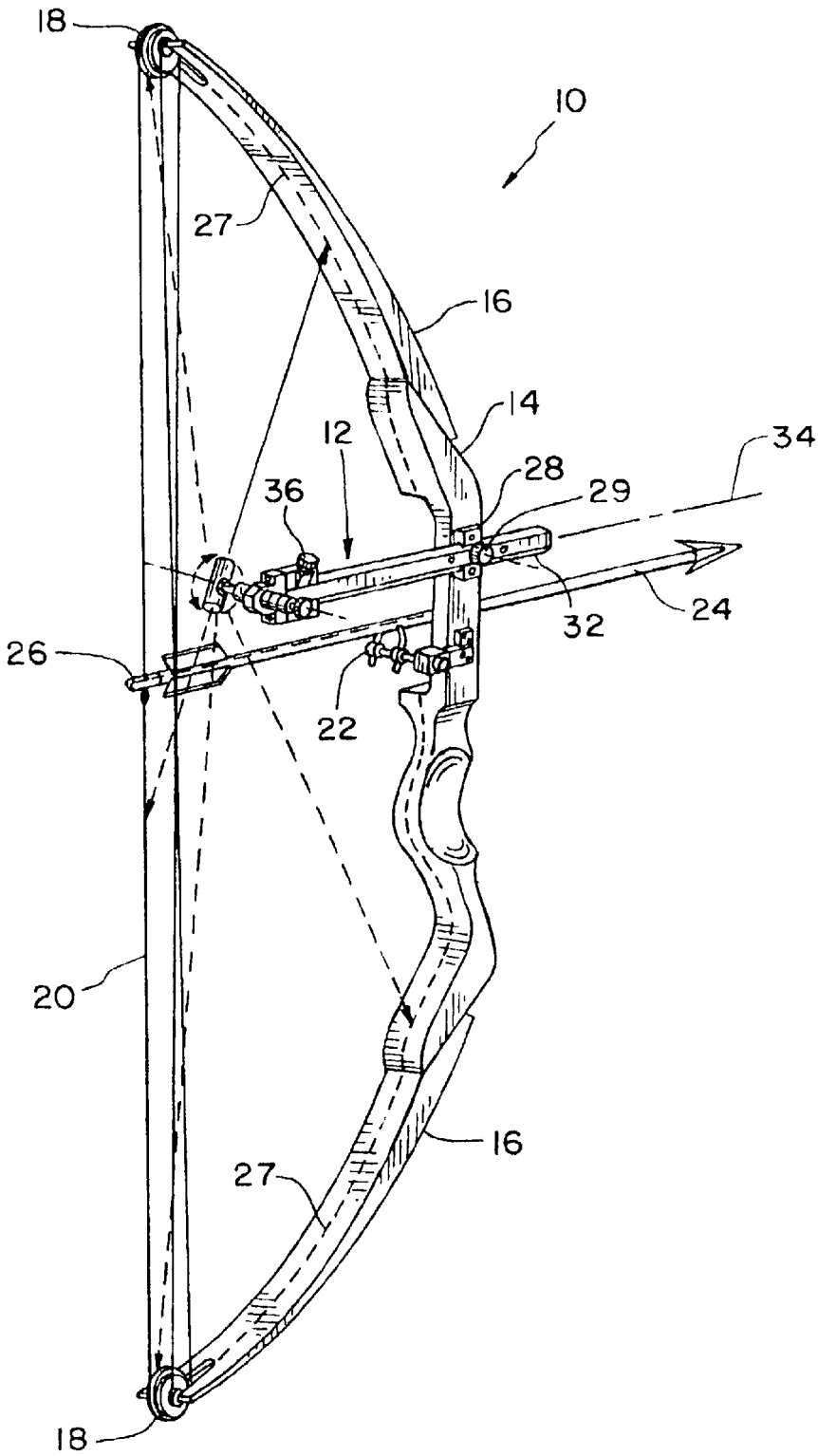
FIG. 1 is a perspective view of an archery bow including an embodiment of a layout device of the present invention.
Figure 2:
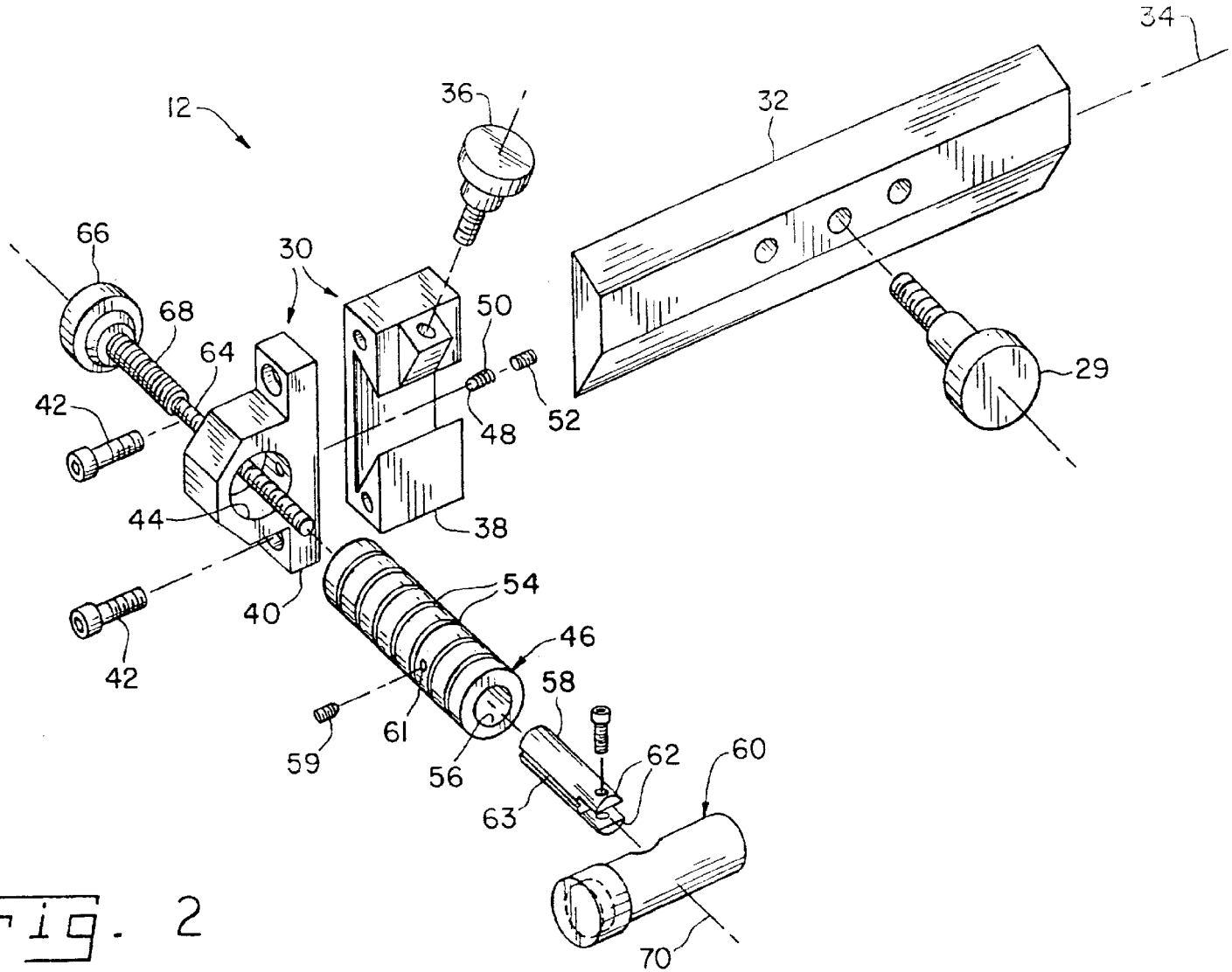
FIG. 2 is an exploded, perspective view of the layout device shown in FIG. 1.

Referring now to the drawings, and more particularly to FIG. 1, there is shown an embodiment of an archery bow 10, incorporating an embodiment of a layout device 12 of the present invention.

In the embodiment shown, bow 10 is a compound bow, but may be differently configured depending upon the application. For example, bow 10 may be a recurve or other type of bow. Bow 10 includes a riser 14 and a pair of flexible limbs 16 extending oppositely from riser 14. At the distal end of each limb 16 is a single cam wheel 18, defining a pair of cam wheels known as a twin cam (or hatchet cam) bow. At least one string 20 wraps around cam wheels 18 and biases limb 16 to a preloaded state. An arrow rest 22 coupled with riser 14 supports an arrow 24. Arrow 24 has a rear end with a nock 26 which is engaged with string 20. Bow 10 has a longitudinal axis 27 defined by riser 14 and limb 16.

Layout device 12 is coupled with riser 14 using any suitable attachment methods. In the embodiment shown, a mount 28 of conventional design is attached to riser 14. Mount 28 typically is used to connect with and carry a sight (not shown), also of conventional design, which allows a user to sight bow 10 on a selected target for launching arrow 24 toward the target. A typical sight may be in the form of a pin sight or optical lens scope. Mount 28 includes a locking knob 29 allowing the sight to be mounted and dismounted from bow 10.

Similarly, layout device 12 may be mounted and dismounted from bow 10 using mount 28 (or other suitable mount in the event mount 28 is not present). Layout device 12 includes a frame 30 with an arm 32 having a male dovetail arrangement for coupling with mount 28. Arm 32 has a longitudinal axis 34, and may be slid along longitudinal axis 34 within mount 28 to a desired mounting position prior to tightening locking knob 29. Arm 32 is also slidably mounted within frame 30 at an opposite end thereof using another locking knob 36.

Frame 30 includes a first body portion 38 and a second body portion 40 which are coupled together, such as by using threaded fasteners 42. First body portion 38 and second body portion 40 can be manufactured as an integral or monolithic part; however, for manufacturing purposes are formed as two parts which are fastened together in the embodiment shown. First body portion 38 includes a female dovetailed recess which receives arm 32, as described above. Second body portion 40 includes a cylindrical opening 44, which receives a cylinder 46, as will be described in more detail hereinafter. A transversely extending ball 48, in communication with cylindrical opening 44, carries a spring biased ball portion of a ball and detent arrangement, including ball 48, compression spring 50 and set screw 52.

Cylinder 46 includes a plurality of axially spaced annular detents 54 which selectively engage spring biased ball 48 within cylindrical opening 44. The ball and detent arrangement of spring biased ball 48 and annular detents 54 defines a coarse axial adjustment of cylinder 46, relative to longitudinal axis 34 of arm 32 and longitudinal axis 27 of bow 10. The number and spacing of annular detents 54 may be selected, depending upon a particular application.

Cylinder 46 has an end in which is formed a bore 56 for receiving plunger 58. Plunger 58 is provided with suitable structure for connecting with laser 60. In the embodiment shown, Plunger 58 has a pair of parallel tangs 62 for engagement with laser 60. A set screw 59 is threaded into a hole 61 formed in cylinder 46. Set screw 59 is threaded into hole 61 to extend into keyway 63 formed in plunger 58. Set screw 59 prevents relative rotation between cylinder 46 and plunger 58.

Laser sight 60 is configured to mount with plunger 58, whether through structure suitable for mounting with tangs 62, or otherwise. Laser 60 includes an on-board electrical power source which rotates with laser 60 during rotation, thereby eliminating the need for electrical cables, etc. In the embodiment shown, laser 60 includes an electrical power source in the form of one or more batteries (not shown).

A threaded rod 64 threadingly engages with an end of plunger 58 opposite from tangs 62. Cylinder 46 has a smaller threaded opening formed generally coaxial with bore 56 which is sized to threadingly receive threaded rod 64. An adjustment knob 66 threadingly engaged with the opposite end of threaded rod 64 allows threaded rod 64 to be rotated within the threaded opening formed in cylinder 46. Rotation of threaded rod 64 thus causes axial movement of plunger 58 and laser 60 relative to longitudinal axes 34 and 27. A compression spring 68 provides tension between second body portion 40 and adjustment knob 66 to hold threaded rod 64 at a desired position. Threaded rod 64 defines a fine axial adjustment of laser 60 relative to longitudinal axes 34 and 27.

During use, layout device 12 is mounted to bow 10 by placing arm 32 within mount 28 and locking arm 32 relative to riser 14 using locking knob 29. Laser 60 is axially adjusted along the longitudinal axis of cylindrical opening 44 relative to a desired reference point using the coarse axial adjustment defined by the ball and detent arrangement 48, 54 and the fine axial adjustment defined by threaded rod 64. For example, laser 60 may be aligned relative to arrow rest 22 and arrow 24. Laser 60 is then rotated about rotation axis 70 of cylinder 46 in a 360° arc to ensure that other relevant reference points also lie in common plane of arrow rest 22 to maximize accuracy of arrow 24 during flight. Set screw 59 prevents relative rotation between plunger 58 and cylinder 46, and in turn causes relative rotation between cylinder 46 and second body portion 40 upon rotation of laser 60. Laser 60 may be rotated along the shaft of arrow 24, string 22 and cam wheels 18. Further, laser 60 may be adjusted relative to an edge of a limb 16 and traced along the edge or centerline of one or both limbs to ensure that the limbs are in line with the longitudinal axis of the bow, either when the bow is in a relaxed state or in a drawn state. Thus, while axially adjusting laser 60 and rotating laser 60 about an arc of at least 180°, preferably in a full circle of 360°, any desired reference point may be checked to ensure maximum accuracy of archery bow 10 during use.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A layout device for use with an archery bow, the bow having a riser, a pair of flexible limbs extending oppositely from the riser and a string extending between ends of the flexible limbs, said layout device comprising:

a frame including an arm configured for coupling with the riser, said arm having a longitudinal axis;

an axial adjustment mechanism carried by said frame, said axial adjustment mechanism being movable relative to said frame in a direction generally orthogonal to said longitidinal axis; and a laser carried by said axial adjustment mechanism, said laser being rotatable at least approximately 180° about a rotation axis extending generally orthogonal to said longitudinal axis, said rotational axis being between the string and the riser; and wherein said laser aligns an arrow, at least one of said limbs and said string.

2. The layout device of claim 1, wherein said laser is rotatable 360° about said rotation axis.

3. The layout device of claim 1, wherein said layout device includes an axial adjustment mechanism for adjusting an offset of said laser from said longitudinal axis.

4. The layout device of claim 3, wherein said frame is coupled with said riser, said axial adjustment mechanism being movable relative to said frame in a direction parallel to said rotation axis.

5. The layout device of claim 4, wherein said axial adjustment mechanism includes a coarse axial adjustment and a fine axial adjustment.

6. The layout device of claim 5, wherein said frame includes a cylindrical opening and said axial adjustment mechanism includes a cylinder axially within said opening.

7. The layout device of claim 6, wherein said coarse axial adjustment includes a ball and detent arrangement between said cylinder and said opening.

8. The layout device of claim 7, wherein said cylinder includes a plurality of axially spaced annular detents and said frame includes a biased ball in communication with said opening, said ball selectively engaging one of said plurality of annular detents.

9. The layout device of claim 6, wherein said fine axial adjustment includes a threaded adjustment.

10. The layout device of claim 9, wherein said cylinder includes a threaded opening and said fine axial adjustment includes a threaded rod within said threaded opening, said laser being connected with said threaded rod.

11. A layout device for use with an archery bow, the bow having a riser, a pair of flexible limbs extending oppositely from the riser and a string extending between ends of the flexible limbs, the bow also having a longitudinal axis, said layout device comprising:

a frame configured for coupling with the riser;

an axial adjustment mechanism carried by said frame, said axial adjustment mechanism being movable relative to said frame in a direction generally orthogonal to the longitidinal axis when said frame is coupled with the riser; and a laser carried by said axial adjustment mechanism, said laser being rotatable at least approximately 180° about a rotation axis extending generally parallel to the direction of movement of said axial adjustment mechanism, said rotational axis being between the string and the riser; and wherein said laser aligns an arrow, at least one of said limbs and said string.

12. An archery bow assembly, comprising:

a bow having a riser, a pair of flexible limbs extending oppositely from said riser, said bow having a longitudinal axis;

a layout device coupled with said riser and a string extending between ends of said flexible limbs, said layout device including a laser which is rotatable at least approximately 180° about a rotation axis generally orthogonal to said longitidinal axis, said rotational axis being between said string and said riser; and wherein said laser aligns an arrow, at least one of said limbs and said string.

13. The archery bow of claim 12, wherein said laser is rotatable 360° about said rotation axis.

14. The archery bow of claim 12, wherein said layout device includes an axial adjustment mechanism for adjusting an offset of said laser from said longitudinal axis, and a frame coupled with said riser, said axial adjustment mechanism being movable relative to said frame in a direction parallel to said rotation axis.

15. The archery bow of claim 14, wherein said axial adjustment mechanism includes a coarse axial adjustment and a fine axial adjustment.

16. The archery bow of claim 14, wherein said axial adjustment mechanism adjusts said offset along said rotation axis.

17. The archery bow of claim 12, wherein said laser includes an electrical power source which rotates with said laser during rotation.

18. The archery bow of claim 17, wherein said electrical power source is at least one battery.

19. A method of laying out an archery bow, comprising the steps of:

providing a bow including a riser, a pair of flexible limbs extending oppositely from said riser, a string, and an arrow rest;

mounting a layout device to said riser, said layout device including a laser which is rotatable 360° about a rotation axis generally extending orthogonal to said longitidinal axis.

axially adjusting said laser relative to said rotation axis; and selectively projecting a laser light beam from said laser onto each of said flexible limbs, said string, and said arrow rest to verify generally that each lie in a common plane.

20. The method of claim 19, wherein said bow further includes a cam wheel at a distal end of each said limb, and said selectively projecting step includes projecting said laser riser onto at least a portion of said cam wheel to verify that said portion of said cam wheel lies in said common plane.

21. The method of claim 19, wherein said bow includes an arrow engaged with each of said string and said arrow rest, and said selectively projecting step includes projecting said laser riser onto at least a portion of said arrow to verify that said portion of said arrow lies in said common plane.

* * * * *